US010684072B2

(12) United States Patent
Rovers et al.

(10) Patent No.: US 10,684,072 B2
(45) Date of Patent: Jun. 16, 2020

(54) METHOD AND SYSTEM FOR PREPARING A LEAN METHANE-CONTAINING GAS STREAM

(71) Applicant: SHELL OIL COMPANY, Houston, TX (US)

(72) Inventors: Stefan Adrianus Rovers, Kuala Belait (BN); Johannes Marinus Van Amelsvoort, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 234 days.

(21) Appl. No.: 15/769,110

(22) PCT Filed: Oct. 18, 2016

(86) PCT No.: PCT/EP2016/074941
§ 371 (c)(1),
(2) Date: Apr. 18, 2018

(87) PCT Pub. No.: WO2017/067908
PCT Pub. Date: Apr. 27, 2017

(65) Prior Publication Data

US 2018/0306498 A1 Oct. 25, 2018

(30) Foreign Application Priority Data

Oct. 21, 2015 (EP) ..... 15190734

(51) Int. Cl.
*F25J 3/06* (2006.01)
*F25J 3/08* (2006.01)
(Continued)

(52) U.S. Cl.
CPC ..... *F25J 3/061* (2013.01); *F25J 1/0022* (2013.01); *F25J 1/0035* (2013.01); *F25J 1/025* (2013.01);
(Continued)

(58) Field of Classification Search
CPC ..... F25J 1/0022; F25J 1/0035; F25J 1/0231; F25J 1/025; F25J 2200/02; F25J 2200/04;
(Continued)

(56) References Cited

U.S. PATENT DOCUMENTS 4,285,708 A 8/1981 Politte et al.
7,386,996 B2 * 6/2008 Fredheim ..... F25J 1/0231 62/612
2006/0260355 A1 11/2006 Roberts et al.

FOREIGN PATENT DOCUMENTS

CN 104628508 A1 5/2015
EP 2597408 A1 5/2013
WO 2004094567 A1 11/2004

OTHER PUBLICATIONS

International Search Report and written opinion received for PCT Application No. PCT/EP2016/074941, dated Jan. 23, 2017, 9 pages.
(Continued)

*Primary Examiner* — Cabrena Holecek

(57) ABSTRACT

The invention relates to a method and system of preparing a lean methane-containing gas stream (22), comprising: —feeding a hydrocarbon feed stream (10) into a separator (100); —withdrawing from the separator (100) a liquid bottom stream (12); —passing the liquid bottom stream (12) to a stabilizer column (200); —withdrawing from the stabilizer column (200) a stabilized condensate stream (13) enriched in pentane, —withdrawing from the stabilizer column (200) a stabilizer overhead stream (14) enriched in ethane, propane and butane; —splitting the stabilizer overhead stream (14) according to a split ratio into a main stream portion (15) and a slip stream portion (16), —passing the slip stream portion (16) to a fractionation unit (300) to obtain an ethane enriched stream (17) and a bottom stream enriched in propane and butane (18).

14 Claims, 2 Drawing Sheets

Figure 1:
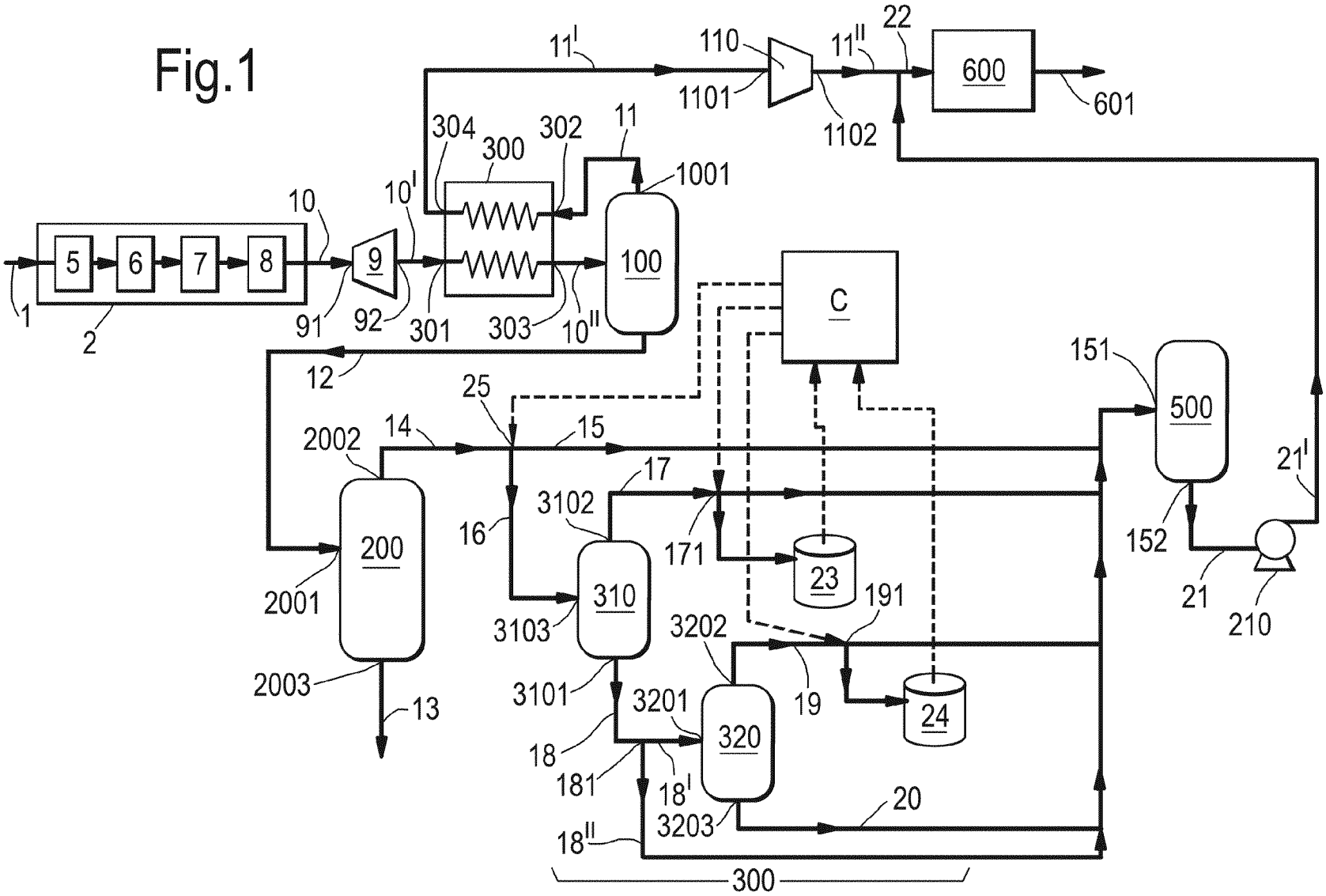

(51) Int. Cl.
*F25J 1/02* (2006.01)
*F25J 3/02* (2006.01)
*F25J 1/00* (2006.01)

(52) U.S. Cl.
CPC ..... *F25J 1/0231* (2013.01); *F25J 3/0209* (2013.01); *F25J 3/0233* (2013.01); *F25J 3/0238* (2013.01); *F25J 3/0242* (2013.01); *F25J 3/0247* (2013.01); *F25J 3/064* (2013.01); *F25J 3/065* (2013.01); *F25J 3/067* (2013.01); *F25J 3/0635* (2013.01); *F25J 3/0645* (2013.01); *F25J 3/08* (2013.01); *F25J 2200/02* (2013.01); *F25J 2200/04* (2013.01); *F25J 2200/06* (2013.01); *F25J 2205/04* (2013.01); *F25J 2210/04* (2013.01); *F25J 2215/02* (2013.01); *F25J 2215/60* (2013.01); *F25J 2215/62* (2013.01); *F25J 2215/64* (2013.01); *F25J 2215/66* (2013.01); *F25J 2220/60* (2013.01); *F25J 2220/66* (2013.01); *F25J 2220/68* (2013.01); *F25J 2230/30* (2013.01); *F25J 2230/60* (2013.01); *F25J 2235/60* (2013.01); *F25J 2240/02* (2013.01); *F25J 2245/02* (2013.01); *F25J 2260/20* (2013.01)

(58) Field of Classification Search
CPC .. F25J 2200/06; F25J 2205/04; F25J 2210/04; F25J 2215/02; F25J 2215/60; F25J 2215/62; F25J 2215/64; F25J 2215/66; F25J 2220/60; F25J 2220/66; F25J 2220/68; F25J 2230/30; F25J 2230/60; F25J 2235/60; F25J 2240/02; F25J 2245/02; F25J 2260/20; F25J 3/0209; F25J 3/0233; F25J 3/0238; F25J 3/0242; F25J 3/0247; F25J 3/061; F25J 3/0635; F25J 3/064; F25J 3/0645; F25J 3/065; F25J 3/067; F25J 3/08
See application file for complete search history.

(56) References Cited

OTHER PUBLICATIONS

Harahap et al., "Fractionation Column Internal Modification to Increase LNG and LPG Productions", AIChE Spring Meeting, Natural Gas Utilization Conference, X, Mar. 10, 2002, pp. 25-34, XP009103067.
Huang et al., "Handling LPG Components in LNG Plants", AIChE Spring Meeting & 7th Global Congress on Process Safety, Mar. 13-17, 2011, 16 pages, XP009163225.

* cited by examiner

METHOD AND SYSTEM FOR PREPARING A LEAN METHANE-CONTAINING GAS STREAM

PRIORITY CLAIM

The present application is the National Stage (§ 371) of International Application No. PCT/EP2016/074941, filed Oct. 18, 2016, which claims benefit of priority from European Application No. 15190734.2, filed Oct. 21, 2015 incorporated herein by reference.

The present invention relates to a method and system for preparing a lean methane-containing gas stream from a hydrocarbon feed stream, in particular a methane-containing gas stream, containing at least methane, ethane, propane, butane and pentane.

An important example of a methane-containing gas is natural gas. Natural gas, and other methane-containing gases, may in addition to methane ("$C_1$") contain amounts of hydrocarbons heavier than methane ("$C_2$+"; sometimes referred to as "higher hydrocarbons" or natural gas liquids (NGL)), including ethane ("$C_2$"), propane ("$C_3$"), butane ("$C_4$"), and hydrocarbons heavier than butane ("$C_5$+"), such as pentane ("$C_5$") and higher. Various hydrocarbons heavier than methane may be extracted from the methane-containing gas to various degrees. The resulting gas may be referred to as a lean methane-containing gas stream (or a methane enriched gas stream), which means that the content of hydrocarbons heavier than methane in the gas stream is lower than in the methane-containing gas prior to said extracting.

The resulting lean methane-containing gas may be employed in various ways, including sending to a pipeline or gas network, for instance to be sold as sales gas, e.g. in the form of domestic gas, and can in particular be liquefied to produce liquid natural gas (LNG). When liquefied, the methane-containing gas stream can be transported and sold in the form of Liquefied Natural Gas (LNG).

The heavier hydrocarbons are usually extracted in condensed form as natural gas liquids ($C_2$+; NGL) and fractionated to yield valuable hydrocarbon products. Such fractionated streams can be used as refrigerant make-up, or sold separately or sold as natural gas liquids (NGL) and/or liquefied petroleum gas (LPG) products or condensates.

Different NGL-extractions schemes are known in the prior art.

For instance, US patent application publication US2006/0260355 describes a process and apparatus for integrated natural gas liquids (NGL) recovery and liquefied natural gas production. An admixture of methane with ethane and higher hydrocarbons is separated in a scrub column into a methane-rich overhead stream and a liquid methane-depleted bottoms liquid. The liquid methane-depleted bottoms liquid, generally described as Natural Gas Liquid (NGL), is fed to a NGL fractionation system. There, NGL is usually reduced in pressure and separated using known separation apparatus such as deethanizer, depropanizer, and/or debutanizer to provide two or more hydrocarbon fractions.

A drawback of US2006/0260355 is that it requires various consecutive fractionation columns in a fractionation train to be operative and more ethane and propane are usually produced than required for refrigerant make-up.

EP2597408 describes a NGL fractionation line-up comprising a series of fractionation columns.

A drawback of the prior art is that such a NGL extraction scheme is relatively expensive and requires a plurality of relatively large fractionation columns placed in series. Such a NGL extraction scheme produces more make-up refrigerants than is normally required and produce a relatively high purity butane enriched stream which are often fully re-injected into the feed stream.

Different line-ups are known from the prior art to separate methane, ethane, propane and butane, such as in WO200494567, CN104628508 and U.S. Pat. No. 4,285,708.

It is therefore an object to provide an improved method and system that overcomes at least one of the disadvantages associated with the prior art.

In a first aspect there is provided a method of preparing a lean methane-containing gas stream, comprising:

- feeding a hydrocarbon feed stream (10) into a separator (100), said hydrocarbon feed stream (10) containing at least methane, ethane, propane, butane and pentane;
- withdrawing from the separator (100) a vaporous methane enriched overhead stream (11) containing at least the majority of the methane from the hydrocarbon feed stream (10);
- withdrawing from the separator (100) a liquid bottom stream (12);
- passing the liquid bottom stream (12) to a stabilizer column (200);
- withdrawing from the stabilizer column (200) a stabilized condensate stream (13) enriched in pentane,
- withdrawing from the stabilizer column (200) a stabilizer overhead stream (14) enriched in ethane, propane and butane;
- splitting the stabilizer overhead stream (14) according to a split ratio into a main stream portion (15) and a slip stream portion (16),
- passing the slip stream portion (16) to a fractionation unit (300) comprising one or more fractionation columns (310, 320) to obtain an ethane enriched stream (17),
- forming the lean methane-containing gas stream (22) by combining
- the vaporous methane enriched overhead stream (11) obtained from the separator (100), and
- the main stream portion (15) of the stabilizer overhead stream (14) obtained from the stabilizer column (200).

According to a further aspect there is provided a system for preparing a lean methane-containing gas stream comprising:

- separator (100) arranged to receive a hydrocarbon feed stream (10) containing at least methane, ethane, propane, butane and pentane;
- the separator (100) comprising an overhead outlet arranged to discharge a vaporous methane enriched overhead stream (11) containing at least the majority of the methane from the hydrocarbon feed stream (10);
- the separator (100) comprising a bottom outlet arranged to discharge a liquid bottom stream (12);
- a stabilizer column (200) being in fluid communication with the bottom outlet of the separator (100) to receive the liquid bottom stream (12),
- the stabilizer column (200) comprising a bottom outlet arranged to discharge a stabilized condensate stream (13) enriched in pentane,
- the stabilizer column (200) comprising an overhead outlet arranged to discharge a stabilizer overhead stream (14) enriched in ethane, propane and butane;
- a splitter (25) arranged to receive the stabilizer overhead stream (14) and split the stabilizer overhead stream (14) into a main stream portion (15) and a slip stream portion (16),
- a fractionation unit (300) being in fluid communication with the splitter (25) to receive the slip stream portion (16), the fractionation unit (300) comprising one or more fractionation columns (310, 320) arranged to obtain an ethane enriched stream (17);

a lean methane-containing gas stream conduit (22) arranged to receive the vaporous methane enriched overhead stream (11) obtained from the separator (100), and the main stream portion (15) of the stabilizer overhead stream (14) obtained from the stabilizer column (200).

Figure 2:
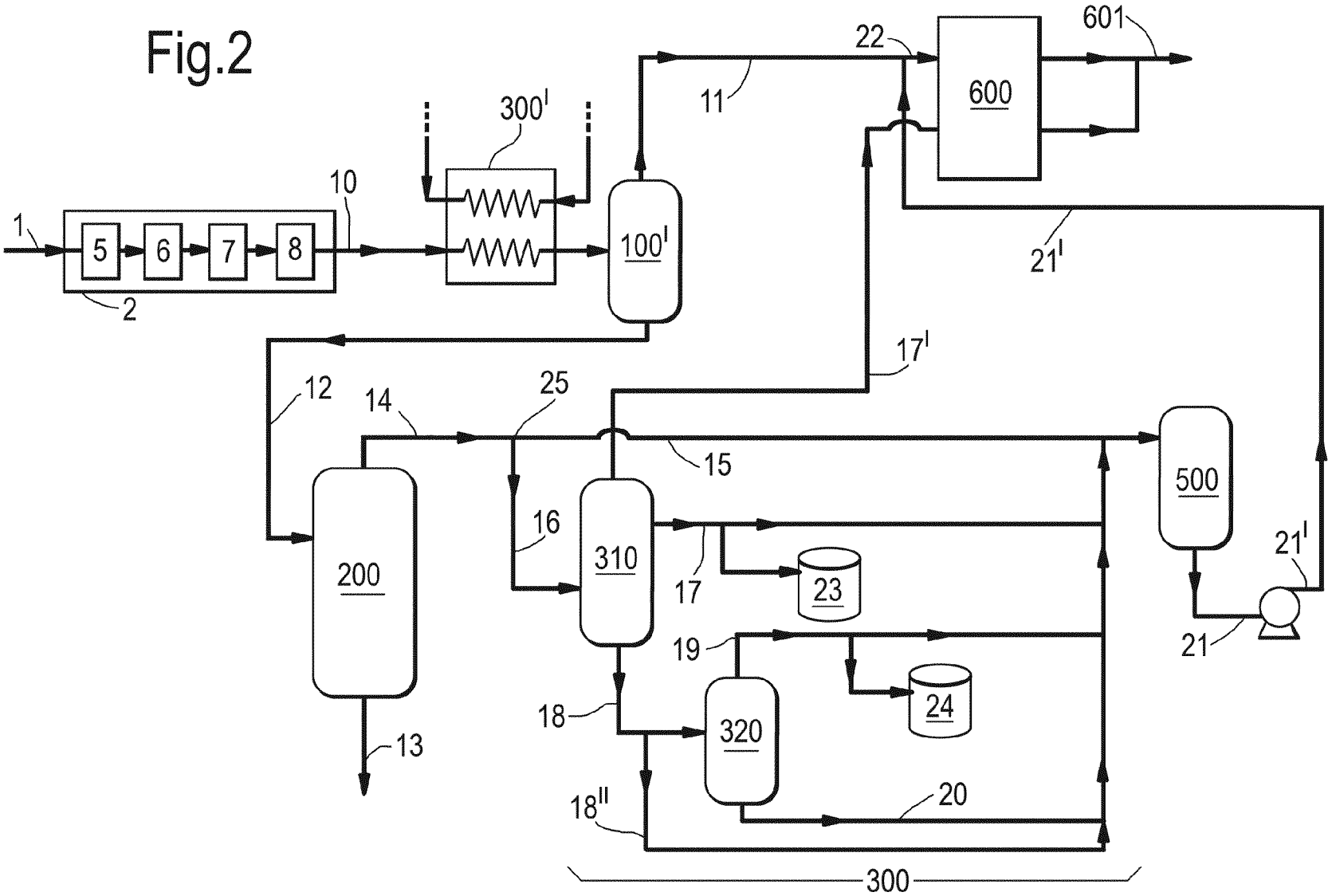

The present invention will now be further illustrated by way of example, and with reference to the accompanying non-limiting drawings, in which:

FIG. 1 schematically shows a process line up for preparing a lean methane-containing gas stream according to a first embodiment;

FIG. 2 schematically shows a process line up for preparing a lean methane-containing gas stream according to an alternative embodiment.

For the purpose of this description, a single reference number will be assigned to a line as well as a stream carried in that line. The same reference numbers refer to similar components, streams or lines.

The method and system as described above have the advantage that the stabilizer column is positioned upstream of the fractionation unit, thereby allowing the fractionation unit to be relatively small. This results in both CAPEX and OPEX savings.

In addition, this line-up makes it possible to, by means of a split stream, only feed the fractionation unit with an amount of molecules necessary for refrigerant make-up. This further results in savings in operational costs and energy savings. Furthermore, this results in production gain when the fractionation unit is by-passed completely and is not in operation. When the fractionation unit is by-passed, the duty needed to operate the fractionation unit, in particular the overhead condenser, becomes available for liquefaction.

In the method and system disclosed here a hydrocarbon feed stream 10 is fed into a separator 100, for instance a scrub column or an (NGL) extraction column 100 as shown in FIG. 1. It will be understood that the hydrocarbon feed stream as provided to the separator 100 may have been subject to upstream gas treating steps to obtain the hydrocarbon feed stream 10 from a natural gas stream or raw hydrocarbon feed stream 1 as obtained from a well.

Depending on the source, the raw hydrocarbon feed stream 1 may contain varying amounts of hydrocarbons heavier than methane such as ethane, propane, butanes and pentanes as well as some aromatic hydrocarbons. The natural gas stream may also contain non-hydrocarbons such as $H_2O$, $N_2$, $CO_2$, $H_2S$ and other sulfur compounds, and the like.

If desired, the raw hydrocarbon feed stream 1 may be pre-treated before using it in the method described herein. This pre-treatment may comprise removal of any undesired components present such as $CO_2$ and $H_2S$.

FIG. 1 shows a gas treating stage 2 arranged to receive a raw hydrocarbon feed stream 1 and produce a hydrocarbon feed stream 10 suitable to be supplied to the separator 100. The gas treating stage may comprise several units.

According to an embodiment, prior to feeding the hydrocarbon feed stream 10 into the separator 100, the method comprises:

receiving a raw hydrocarbon feed stream 1 and passing the raw hydrocarbon feed stream 1 through one or more of the following units to obtain the hydrocarbon feed stream 10:

condensate removal unit 5 arranged to remove condensable such as water and added corrosion inhibitors, acid gas removal unit 6 arranged to lower amount of acid components, such as $CO_2$ and $H_2S$, dehydration unit 7 arranged to lower the water content, mercury removal unit 8 arranged to lower a mercury content.

FIG. 1 schematically depicts a gas treating stage 2 comprising the condensate removal unit 5, the acid gas removal unit 6, the dehydration unit 7 and the mercury removal unit 8 in series. It will be understood that one or more units may be omitted or added depending on the composition of the raw hydrocarbon feed stream 1. No side streams, bleed streams and the like are depicted in FIG. 1.

The hydrocarbon feed stream 10 as fed to the separator 100 typically comprises more than 80 mol % methane or more than 90 mol %, and typically less than 20 mol % $C_2$+-components or less than 10 mol % $C_2$+-components.

The $C_2$+ components may for instance comprises 4-8 mol % C2, 1-3 mol % C3, 0.2-1 mol % C4 and 0.1-0.8 mol % $C_5$+.

According to the method and system provided a lean methane-containing gas stream is obtained comprising a higher methane fraction than the methane fraction of the hydrocarbon feed stream 10, e.g. more than 90 mol % methane, and typically less than 10 mol % $C_2$+-components, or more than 92 mol % methane, and typically less than 8 mol % $C_2$+-components.

The lean methane-containing gas stream may also be referred to as a methane enriched gas stream and is referred to in this text as the lean methane-containing gas stream 22.

According to an embodiment the separator 100 is one of a scrub column and an extraction column.

The embodiment shown in FIG. 1 comprises an extraction column 100. An embodiment comprising a scrub column will be described in more detail below with reference to FIG. 2.

A vaporous methane enriched overhead stream 11 containing at least the majority of the methane from the hydrocarbon feed stream 10 is obtained from the separator 100. The liquid bottom stream 12 may still comprise some level of methane.

When using an extraction column for separator 100, the level of methane in the liquid bottom stream 12 is relatively small and no further processing steps are usually required to separate the methane from the liquid bottom stream. FIG. 1 shows an embodiment with an extraction column 100.

When using a scrub column, additional processing steps and hardware may be needed to separate the methane from the liquid bottom stream. This will be described in more detail below with reference to FIG. 2.

An extraction column 100 is advantageous in situations where a high LPG recovery is desired, a lean feed gas is used or for floating LNG.

According to an embodiment and as shown in FIG. 1, feeding the hydrocarbon feed stream 10 into the separator 100 comprises providing the hydrocarbon feed stream 10, cooling the hydrocarbon feed stream 10 by passing the hydrocarbon feed stream 10 over an expansion-cooling device 9, such as a valve or an expander, to obtain a cooled hydrocarbon feed stream 10' and further cooling the cooled hydrocarbon feed stream 10' by heat exchanging against the vaporous methane enriched overhead stream 11, obtaining a further cooled hydrocarbon feed stream 10" and a warmed vaporous methane enriched overhead stream 11', feeding the further cooled hydrocarbon feed stream 10" into the separator 100, compressing the warmed vaporous methane enriched overhead stream 11' obtaining a pressurized warmed vaporous methane enriched overhead stream 11" and passing the warmed vaporous methane enriched overhead stream 11' to be comprised in the lean methane-containing gas stream 22.

The extraction column 100 is typically operated at a pressure in the range of 20-30 bara.

FIG. 1 schematically shows an expansion-cooling device 9, which may also be referred to as a pressure-reduction device, comprising an inlet 91 to receive the hydrocarbon feed stream and comprising an outlet 92 for discharging the cooled hydrocarbon feed stream 10'.

The term expansion-cooling device 9 is used to refer to an expansion device in which the stream cools at least partially because of the expansion.

FIG. 1 further schematically depicts a heat exchanger 300 comprising a first inlet 301 for receiving the cooled hydrocarbon feed stream 10', a second inlet 302 for receiving the vaporous methane enriched overhead stream 11, a first outlet 303 for discharging the further cooled hydrocarbon feed stream 10" and a second outlet 304 for discharging the warmed vaporous methane enriched overhead stream 11'. The heat exchanger 300 may be any suitable type of indirect heat exchanger, i.e. a heat exchanger in which the fluids that exchange heat are not in direct contact with each other and don't mix.

Separator 100 comprises a top outlet 1001 arranged to discharge the vaporous methane enriched overhead stream 11 containing at least the majority of the methane from the hydrocarbon feed stream 10. The top outlet 1001 is in fluid communication with the second inlet 302 of the heat exchanger 300.

The second outlet 304 of the heat exchanger 300 is in fluid communication with an inlet 1101 of a compressor 110 to obtain a compressed warmed vaporous methane enriched overhead stream 11". The compressed warmed vaporous methane enriched overhead stream 11' is discharged through an outlet 1102 of the compressor. The compressed warmed vaporous methane enriched overhead stream 11' typically has a pressure in the range of 50-90 bara or 50-70 bara, e.g. 60 bara. The outlet 1102 is in fluid communication with a lean methane-containing gas stream conduit arranged to carry the lean methane-containing gas stream 22.

Heat exchanger 300 is depicted as a single heat exchanger, but it will be understood that heat exchanger 300 may comprise multiple heat exchangers, e.g. two heat exchangers, positioned in series. Heat exchanger 300 may comprise first heat exchanger(s) upstream of expansion-cooling device 9 and second heat exchanger(s) downstream of expansion-cooling device 9.

Upstream of separator 100 may be a pre-cooler, such as a propane cooler or mixed refrigerant cooler. The pre-cooler is typically positioned in between gas treating stage 2 and expansion-cooling device 9.

According to an embodiment, the cooled hydrocarbon feed stream 10' has a pressure in the range of 25-40 bar and has a temperature in the range of −65° C.--30° C.

According to an embodiment the method further comprises feeding the lean methane-containing gas stream 22 to a liquefaction system 600 to obtain a liquefied lean methane-containing stream 601.

In FIG. 1 the liquefaction system 600 is shown as a box representing the different types of liquefaction systems that may be employed. The liquefaction system 600 may comprise a main cryogenic heat exchanger in which the lean methane-containing gas stream 22 is cooled against a mixed refrigerant, preferably split in a heavy and light mixed refrigerant, and an end flash in which further cooling and liquefaction is achieved.

The liquefied lean methane-containing stream 601, also referred to as LNG, may be passed to a LNG storage tank or a LNG carrier to be transported.

Alternatively, the lean methane containing gas stream 22 may be passed into the gas network, for instance to be sold as sales gas, e.g. in the form of domestic gas (not shown).

In the method and system disclosed here the liquid bottom stream 11 obtained from the separator 100 is first passed to a stabilizer column to separate the majority of the "$C_5$+" molecules before separating the lighter components, in particular ethane (C2) and propane (C3), in a fractionation unit 300.

The separator 100 comprises a bottom outlet 1002 which is in fluid communication an inlet 2001 of the stabilizer column 200 to introduce the liquid bottom stream 12 obtained from the separator 100 at an intermediate level in the stabilizer column 200.

The stabilizer column 200 produces a (stabilized) plant condensate of (stabilized) condensate stream 13 enriched in pentane. The (stabilized) condensate stream 13 may further be enriched in C6+ components.

The stabilizer column 200 comprises a bottom outlet 2003 arranged to discharge the (stabilized) condensate stream 13 and for instance pass the (stabilized) condensate stream 13 to a (stabilized) condensate storage tank (not shown).

According to an embodiment, the pressure level in the stabilizer column 200 is below 17 bara.

Typically the pressure is higher at the bottom of the stabilizer column than it is at the top of the stabilizer column. The indication that the pressure level in the stabilizer column 200 is below 17 bara is to be understood that the pressure at the top and the bottom is below this value. According to an example, the pressure is 16.5 bara at the top and 16.8 bara at the bottom.

This provides the advantage that the stabilizer overhead stream 14 enriched in ethane, propane and butane can be condensed with ambient cooling duty, in particular by an ambient water stream, thereby avoiding the need to take cooling duty from the refrigerant cycles used to cool and liquefy the hydrocarbon feed stream 10.

According to an embodiment the fractionation unit 300 comprises a first fractionation column 310 and a second fractionation column 320, wherein passing the slip stream portion 16 to the fractionation unit 300 comprises:

feeding the slip stream portion 16 to the first fractionation column 310, obtaining the ethane enriched stream 17 as top stream from the first fractionation column 310 and obtaining the bottom stream enriched in propane and butane 18 from the first fractionation column 310, passing the bottom stream enriched in propane and butane 18 to the second fractionation column 320, obtaining a propane enriched stream 19 as top stream from the second fractionation column 320 and obtaining a butane enriched stream 20 as bottom stream from the second fractionation column 320.

The bottom stream enriched in propane and butane 18 may be introduced in the second fractionation column 320 at an intermediate level/height.

The fractionation unit 300 typically comprises a first fractionation column 310 being a de-ethanizer column and a second fractionation column 320 being a de-propanizer column.

The last two steps (—passing the bottom stream enriched in propane and butane 18 to the second fractionation column 320, —obtaining a propane enriched stream 19 as top stream from the second fractionation column 320 and obtaining a butane enriched stream 20 as bottom stream from the second fractionation column 320) are optional and may be replaced by passing the bottom stream enriched in propane and butane 18 to a propane and butane storage or adding the bottom stream enriched in propane and butane 18 to the lean methane-containing gas stream 22. This last option is shown by stream 18" in FIG. 1.

Conduit 18 providing fluid communication between a bottom outlet 3101 of the first fractionation column 310 and an inlet 3201 of the second fractionation column 320 comprises a controllable splitter 181 arranged to pass the bottom stream enriched in propane and butane 18 to the inlet 3201 of the second fractionation column 320 or to a by-pass conduit 18" to by-pass the second fractionation column 320. The controllable splitter 181 may be valve.

So according to an embodiment the second fractionation column 320 may be by-passed. This may advantageously be done in situations where ethane make-up refrigerant needs to be produced, but no propane make-up refrigerant is needed. The by-pass conduit 18" is arranged to pass the bottom stream enriched in propane and butane 18 to be combined with the lean methane-containing gas stream conduit 22.

As indicated above, the stabilizer overhead stream 14 is split according to a split ratio into a main stream portion 15 which is passed on to be part of the lean methane-containing gas stream 22 and a slip stream portion 16 which is passed to the fractionation unit 300.

By placing the stabilizer column 200 upstream of the fractionation unit 300 it is possible to send only a slip stream (e.g. 10%) to the fractionation unit 300 and thereby significantly reduce the size and the required heating/cooling duties required for operating the fractionation unit 300.

In addition, the fractionation unit 300 may be by-passed partially or completely when no separate production of ethane and propane is needed, for instance when no refrigerant make-up production is needed.

According to an embodiment, the split ratio is defined as the flow rate of the split stream portion 16 divided by the flow rate of the stabilizer overhead stream 14 and the method comprises actively controlling the split ratio.

According to an embodiment the split ratio is actively controlled to vary in the range 0-0.25, preferably in the range 0-0.10.

According to an embodiment, the split ratio is actively controlled to binary switch between a first and second value, the first value being 0, the second value being greater than zero. The second value may be a fixed value (e.g. 0.1 or 0.25) or may be selected to ensure that the flow rate of the split stream is in a predetermined range or has a predetermined value to ensure optimal functioning of the fractionation unit 300.

The stabilizer column 200 comprises a top outlet 2002 arranged to discharge the stabilizer overhead stream 14 via an overhead conduit 14.

The stabilizer overhead stream 14 may be a vaporous stream, a liquid stream or a multiphase stream comprising vapour and liquid.

The overhead conduit 14 provides fluid communication between the top outlet 2002 and a splitter 25, the splitter 25 being arranged to receive the stabilizer overhead stream 14 and split the stabilizer overhead stream 14 into a main stream portion 15 and a slip stream portion 16. The slip stream portion 16 is passed to an inlet 3103 of the first fractionation column 310 via a slip stream conduit 16.

The splitter preferably is a controllable splitter and may be formed by a controllable three-way valve.

It is noted that the composition of the stabilizer overhead stream 14, the main stream portion 15 and the split stream portion 16 are the same.

The first fractionation column 310 further comprises a top outlet 3102 arranged to discharge the ethane enriched stream 17 to be combined with the lean methane-containing gas stream 22.

The method and system reduces the volume of the fractionation unit significantly and thus provides plot-space savings.

For instance, comparing a traditional line-up (de-ethanizer, de-propanzier, stabilizer) to the here suggested line-up (stabilizer, de-ethanizer, de-propanizer), the column diameter of the de-ethanizer and the de-propanizer can be significantly be reduced, i.e. up to approximately 70% each.

Furthermore, OPEX savings are obtained as operating smaller fractionation columns requires less energy and the fractionation unit does not always need to be (fully) operated.

The method and system are thus able to produce stabilized plant condensate and on demand produce ethane and/or propane enriched streams when refrigerant make-up is required or desired.

So, according to an embodiment the method further comprises passing the ethane enriched stream 17 to an ethane storage 23 or adding the ethane enriched stream 17 to the lean methane-containing gas stream 22, passing the propane enriched stream 19 to a propane storage 24 or adding the propane enriched stream 19 to the lean methane-containing gas stream 22, passing the butane enriched stream 20 to a butane storage (not shown) or adding the butane enriched stream to the lean methane-containing gas stream 22.

Top outlet 3102 of the first fractionation column 310 is arranged to discharge the ethane enriched stream 17 to be combined with the lean methane-containing gas stream 22 or to be added to the ethane storage 23. Conduit 17 may comprise a splitter 171, preferably a controllable splitter, to control the amount of ethane enriched stream to be passed to the ethane storage 23 or to the lean methane-containing gas stream 22.

Top outlet 3202 of the second fractionation column 320 is arranged to discharge the propane stream 19 to be combined with the lean methane-containing gas stream 22 or to be added to the propane storage 24. Conduit 19 may comprise a splitter 191, preferably a controllable splitter, to control the amount of propane enriched stream to be passed to the propane storage 24 or to the lean methane-containing gas stream 22.

Bottom outlet 3203 of the second fractionation column 320 arranged to carry butane enriched stream is in fluid communication with the lean methane-containing gas stream 22, preferably via re-injection vessel 500, as described in more detail below.

Conduit 18 provides a fluid connection between bottom outlet 3101 and inlet 3201 of the second fractionation column 320.

Any excess streams other than the stabilized condensate stream 13 and the fractionated ethane and propane needed for refrigerant make-up can be re-injected or combined with the vaporous methane enriched overhead stream 11 which is to be liquefied.

The splitters 25, 171, 181, 191 may be controlled by a controller C which provides a control signal to at least splitter 25 and optionally also to the respective splitters 171, 181, 191. Controller C may be embodied by any kind of suitable computer and may also be embedded in a larger controller controlling larger parts of the system shown in FIG. 1.

The controller C is arranged to compute a target split ratio and generate a control signal to control splitter 25 in accordance with the target split ratio. The controller C is further arranged to receive and process indications of the amount of ethane present in the ethane storage 23 and the amount of propane present in the propane storage 24.

The controller C may further be arranged to optionally control splitters 171, 181, 191. The controller C may be arranged to

- provide a control signal to control splitter 171 to control the amount of ethane enriched stream to be passed to the ethane storage 23 and to the lean methane-containing gas stream 22;
- provide a control signal to control splitter 191 to control the amount of propane enriched stream to be passed to the propane storage 24 or to the lean methane-containing gas stream 22; and/or
- provide a control signal to control splitter 181 to control the amount of propane and butane enriched stream 18 to be passed to and to by-pass the second fractionation column 320.

All streams formed from the liquid bottom stream 12 obtained from the separator 100, preferably being an extraction column, that are to be added to the lean methane-containing gas stream 22 are preferably first collected in a re-injection vessel 500.

So, according to an embodiment, the method comprises collecting in a re-injection vessel 500:

- the main stream portion 15 of the stabilizer overhead stream 14 obtained from the stabilizer 200,
- optionally the top stream enriched in ethane 17,
- optionally the top stream enriched in propane 19, and
- optionally the butane enriched stream 20 obtained from the fractionation unit 300,
- obtaining a re-injection stream 21 from the re-injection vessel 500 and
- combining the re-injection stream 21 with the vaporous methane enriched overhead stream 11 obtained from the separator 100 to form the lean methane-containing gas stream 22.

It will be understood that collecting the different streams in the re-injection vessel 500 may comprise applying pressure equalizing steps to equalize the pressures of the different streams to allow the streams to be combined.

Optionally, in case the fractionation unit 300 also produces a vaporous methane enriched stream, the vaporous methane enriched stream is preferably liquefied before being collected in the re-injection vessel 500. Alternatively the vaporous methane enriched stream is passed through the liquefaction system 600, in particular through the main cryogenic heat exchanger, in parallel to the lean methane-containing gas stream 22.

Combining the re-injection stream 21 with the vaporous methane enriched overhead stream 11 may comprise compressing the re-injection stream 21 using a pump 210 to obtain a pressurized re-injection stream 21'.

The re-injection vessel 500 comprises one or more inlets 151 arranged to receive the above mentioned streams. Preferably, the re-injection vessel 500 comprises an inlet 151 for each of the above mentioned stream. Alternatively, as shown by way of example in the figures, the streams are combined upstream of the re-injection vessel 500.

The re-injection vessel 500 comprises an outlet 152 which is in fluid communication with conduit 11 via conduit 21, 21' to combine the re-injection stream 21 with the vaporous methane enriched overhead stream 11 obtained from the separator 100 to form the lean methane-containing gas stream 22.

According to a further embodiment, the separator 100 is a scrub column. An embodiment is schematically depicted in FIG. 2.

The (pre-treated) hydrocarbon feed stream 10 is cooled in pre-cooler (which was not shown in FIG. 1) by either a propane or a mixed refrigerant cycle to e.g. −12° C.

In case of a propane pre-cooler the scrub column 100' overhead is cooled in a heat exchanger (e.g. kettle, not shown) to a minimum temperature of approximately −34° C. (minimum Propane temperature plus 3° C.) and passed on to the liquefaction system 600.

As the liquid bottom stream 12 from the scrub column typically has a relatively high content of methane, as shown in FIG. 2, the first fractionation column 310 may now be a three way separator, from which a methane enriched stream 17' is obtained as top stream, an ethane enriched stream 17 is obtained as side stream and a propane and butane enriched stream 18 is obtained as bottom stream.

The method may for instance comprise

- feeding the slip stream portion 16 to the first fractionation column 310,
- obtaining a methane enriched stream 17' as top stream from the first fractionation column, obtaining the ethane enriched stream 17 as side stream from the first fractionation column 310 and obtaining the bottom stream enriched in propane and butane 18 from the first fractionation column 310, and
- forming the lean methane-containing gas stream 22 by combining
- the vaporous methane enriched overhead stream 11 obtained from the separator 100,
- the methane enriched stream 17 obtained as top stream from the first fractionation column 310, and
- the main stream portion 15 of the stabilizer overhead stream 14 obtained from the stabilizer column 200.

Alternatively, the methane enriched stream 17' obtained as top stream may be passed to the liquefaction system 600 to be cooled and liquefied separately to and parallel from the lean methane-containing gas stream 22 and being combined therewith downstream of the liquefaction system 600.

The person skilled in the art will understand that the present invention can be carried out in many various ways without departing from the scope of the appended claims. For instance, where the word step or steps is used it will be understood that this is not done to imply a specific order. The steps may be applied in any suitable order, including simultaneously.

That which is claimed is:

1. A method of preparing a lean methane-containing gas stream, comprising:

- feeding a hydrocarbon feed stream into a separator, said hydrocarbon feed stream containing at least methane, ethane, propane, butane and pentane;

withdrawing from the separator a vaporous methane enriched overhead stream containing at least a majority of the methane from the hydrocarbon feed stream;

withdrawing from the separator a liquid bottom stream;

passing the liquid bottom stream to a stabilizer column;

withdrawing from the stabilizer column a stabilized condensate stream enriched in pentane, withdrawing from the stabilizer column a stabilizer overhead stream enriched in ethane, propane and butane;

splitting the overhead stream according to a split ratio into a main stream portion and a slip stream portion, passing the slip stream portion to a fractionation unit comprising one or more fractionation columns to obtain an ethane enriched stream and a bottom stream enriched in propane and butane, forming the lean methane-containing gas stream by combining the the vaporous methane enriched overhead stream obtained from the separator, and the main stream portion of the stabilizer overhead stream obtained from the stabilizer column.

2. The method according to claim 1, wherein the method further comprises feeding the lean methane-containing gas stream to a liquefaction system to obtain a liquefied lean methane-containing stream.

3. The method according to claim 1, wherein the separator is one of a scrub column and an extraction column.

4. The method according to claim 1, wherein the fractionation unit comprises a first fractionation column and a second fractionation column, wherein passing the slip stream portion to the fractionation unit comprises:

feeding the slip stream portion to the first fractionation column, obtaining the ethane enriched stream as top stream from the first fractionation column and obtaining the bottom stream enriched in propane and butane from the first fractionation column, passing the bottom stream enriched in propane and butane to the second fractionation column, obtaining a propane enriched stream as top stream from the second fractionation column and obtaining a butane enriched stream as bottom stream from the second fractionation column.

5. The method according to claim 1, wherein the method further comprises passing the ethane enriched stream to an ethane storage or adding the ethane enriched stream to the lean methane-containing gas stream, passing the propane enriched stream to a propane storage or adding the propane enriched stream to the lean methane-containing gas stream, passing the butane enriched stream to a butane storage or adding the butane enriched stream to the lean methane-containing gas stream.

6. The method according to claim 1, wherein the method comprises collecting in a re-injection vessel:

the vaporous methane enriched overhead stream obtained from the separator, the main stream portion of the stabilizer overhead stream obtained from the stabilizer column, the butane enriched stream obtained from the fractionation unit, optionally the top stream enriched in ethane and optionally the top stream enriched in propane;

obtaining a re-injection stream from the re-injection vessel and combining the re-injection stream with the vaporous methane enriched overhead stream obtained from the separator to form the lean methane-containing gas stream.

7. The method according to claim 1, wherein the split ratio is defined as the flow rate of the split stream portion divided by the flow rate of the stabilizer overhead stream and wherein the method comprises actively controlling the split ratio.

8. The method according to claim 1, wherein the split ratio is actively controlled to vary in the range 0-0.25.

9. The method according to claim 1, wherein feeding the hydrocarbon feed stream into the separator comprises providing the hydrocarbon feed stream, cooling the hydrocarbon feed stream by passing the hydrocarbon feed stream over an expansion-cooling device, such as a valve or an expander, to obtain a cooled hydrocarbon feed stream and further cooling the cooled hydrocarbon feed stream by heat exchanging against the vaporous methane enriched overhead stream, obtaining a further cooled hydrocarbon feed stream and a warmed vaporous methane enriched overhead stream, feeding the further cooled hydrocarbon feed stream into the separator, compressing the warmed vaporous methane enriched overhead stream obtaining a pressurized warmed vaporous methane enriched overhead stream and passing the warmed vaporous methane enriched overhead stream to be comprised in the lean methane-containing gas stream.

10. The method according to claim 1, wherein prior to feeding the hydrocarbon feed stream into the separator, the method comprises:

receiving a raw hydrocarbon feed stream and passing the raw hydrocarbon feed stream through one or more of the following units to obtain the hydrocarbon feed stream:

condensate removal unit arranged to remove condensable such as water and added corrosion inhibitors, acid gas removal unit arranged to lower amount of acid components, such as $CO_2$ and $H_2S$, dehydration unit arranged to lower the water content, mercury removal unit arranged to lower a mercury content.

11. The method according to claim 1, wherein the pressure level in the stabilizer column is below 17 bara.

12. The method according to claim 1, wherein the method further comprises:

adding the butane enriched stream obtained from the fractionation unit to the methane enriched liquefaction feed stream or passing the butane enriched stream to a butane storage.

13. A system for preparing a lean methane-containing gas stream comprising:

a separator arranged to receive a hydrocarbon feed stream containing at least methane, ethane, propane, butane and pentane;

the separator comprising an overhead outlet arranged to discharge a vaporous methane enriched overhead stream containing at least a majority of the methane from the hydrocarbon feed stream;

the separator comprising a bottom outlet arranged to discharge a liquid bottom stream;

a stabilizer column being in fluid communication with the bottom outlet of the separator to receive the liquid bottom stream, the stabilizer column comprising a bottom outlet arranged to discharge a stabilized condensate stream enriched in pentane, the stabilizer column comprising an overhead outlet arranged to discharge a stabilizer overhead stream enriched in ethane, propane and butane;

a splitter arranged to receive the stabilizer overhead stream and split the stabilizer overhead stream into a main stream portion and a slip stream portion, a fractionation unit being in fluid communication with the splitter to receive the slip stream portion, the fractionation unit comprising one or more fractionation columns arranged to obtain an ethane enriched stream;

a lean methane-containing gas stream conduit arranged to receive the vaporous methane enriched overhead stream obtained from the separator, and the main stream portion of the stabilizer overhead stream obtained from the stabilizer column.

14. The method according to claim 1, wherein the split ratio is actively controlled to vary in the range 0-0.10.

* * * * *